US007403167B2

(12) United States Patent
Probst et al.

(10) Patent No.: US 7,403,167 B2
(45) Date of Patent: Jul. 22, 2008

(54) ANTENNA CONFIGURATION FOR RADIO RECEPTION IN MOTOR VEHICLES

(75) Inventors: Wilhelm Probst, Bockenem (DE); Jürgen Sczesny, Hildesheim (DE); Detlef Wunnenberg, Bad Salzdetfurth (DE); Laila Bekraoui, München (DE)

(73) Assignees: Delphi Delco Electronics Europe GmbH, Bad Salzdetfurth (DE); Bayerische Motoren Werke AG, Munich (DE)

( * ) Notice: Subject to any disclaimer, the term of this patent is extended or adjusted under 35 U.S.C. 154(b) by 263 days.

(21) Appl. No.: 11/437,045

(22) Filed: May 19, 2006

(65) Prior Publication Data

US 2006/0267849 A1 Nov. 30, 2006

(30) Foreign Application Priority Data

May 24, 2005 (DE) ..... 20 2005 008 338 U

(51) Int. Cl.
*H01Q 1/32* (2006.01)

(52) U.S. Cl. ..... 343/713; 343/711

(58) Field of Classification Search ..... 343/711, 343/712, 713, 714, 715, 716
See application file for complete search history.

(56) References Cited

U.S. PATENT DOCUMENTS

| | | | | |
|---|---|---|---|---|
| 4,791,426 | A | 12/1988 | Lindenmeier et al. | |
| 5,061,942 | A | 10/1991 | Dörrie et al. | |
| 5,177,493 | A | 1/1993 | Kawamura | |
| 6,054,821 | A | 4/2000 | Koch et al. | |
| 6,184,837 | B1 | 2/2001 | Lindenmeier et al. | |
| 6,812,901 | B2 * | 11/2004 | Deininger | 343/713 |
| 2003/0034927 | A1 * | 2/2003 | Deininger | 343/713 |
| 2004/0174312 | A1 * | 9/2004 | Wiedmann et al. | 343/711 |

FOREIGN PATENT DOCUMENTS

| | | |
|---|---|---|
| DE | 38 02 130 | 8/1989 |
| DE | 295 13 911 | 12/1995 |
| DE | 102 06 350 | 8/2003 |
| EP | 0 911 200 | 4/1999 |
| FR | 2 732 514 | 10/1996 |

* cited by examiner

*Primary Examiner*—HoangAnh T Le
(74) *Attorney, Agent, or Firm*—Collard & Roe, P.C.

(57) ABSTRACT

An antenna configuration is provided for radio reception in motor vehicles, the roof region of which is made predominantly of dielectric materials, and for motor vehicles having roof structures that can be collapsed for open driving operation. The antenna configuration includes a combination of emitters that are integrated into elements of the roof region, with emitters that are disposed in cavities of the interior paneling essentially below the belt line of the vehicle. A ground connection is provided for emitters that are disposed in a roof structure having movable elements by way of at least one resilient contact between movable metal components of the roof structure and the metal car body. Also included is a switching system for alternating operation of the emitters.

7 Claims, 3 Drawing Sheets

ANTENNA CONFIGURATION FOR RADIO RECEPTION IN MOTOR VEHICLES

CROSS REFERENCE TO RELATED APPLICATIONS

Applicants claims priority under 35 U.S.C. §119 of German Application No. 20 2005 008 338.0 filed on May 24, 2005.

BACKGROUND OF THE INVENTION

1. Field of the Invention

The invention relates to an antenna configuration for motor vehicles, the roof region of which is made predominantly of dielectric materials, and for motor vehicles having roof structures that can be collapsed for open driving conditions.

2. The Prior Art

An antenna is essentially defined by the emitter as a wave-type converter (free-space wave to line-conducted wave or vice versa), which is electrically effective for a certain frequency range because of its geometrical configuration, and is in resonance; the feed point as the interface between emitter and line, at which the wave is coupled in and out, respectively; as well as the ground reference or counter-pole.

The function of an antenna is represented by means of the radiation characteristics (viewed spatially), or by means of radiation diagrams (in vertical or horizontal section).

For motor vehicles having metal bodies with an essentially unchangeable body structure, the placement of antennas and their function in interaction with the aforementioned components present no problems. The antennas in a rear window surrounded by sheet-metal surfaces, the rod antennas on the metal roof of a sedan, and others, can be positioned and optimized for stable function without any great difficulties, with regard to the implementation of the emitters as well as the assignment of the feed point and a sufficient ground connection, taking into consideration the high frequency (HF)-related specifics of the motor vehicle body, in each instance.

It is different for vehicles having variable body components and for vehicles having body parts made of dielectric materials.

In the present context, the variability relates to the roof construction, specifically in the case of convertibles. Nowadays, a differentiation is made, in the case of convertibles, between a folding roof made of metal elements, and the conventional structure made of a metal frame of connecting rods covered with fabric or plastic surfaces.

For such vehicles as well, rear windows having integrated antenna structures are known. These antennas can be used for radio services as long as the roof does not disappear under the cover or in the trunk in the collapsed state.

For the case of the open roof, rod antennas, in most cases on the fenders, or antennas in the bumper area are generally used as an alternative.

The rod antennas are exposed to vandalism and theft. The antennas in the bumper, on the other hand, are highly direction-oriented, with the sheet-metal body "at their back," and one should place at least two emitters in opposite directions on the vehicle, combined with diversity or phase-regulated signal integration. In this connection, long HF lines between the individual feed points and to the receiver are then unavoidable. Fundamentally, placement at a low height in the bumper is also not the most advantageous for reception.

For a rear window that is surrounded by a fabric cover, on the other hand, a ground connection can be a problem. Possible solutions would be a ground-plane arrangement or dipole arrangement. Something like those solutions would be complicated, however, and would limit the window area that is available for a multi-antenna arrangement, for example.

SUMMARY OF THE INVENTION

It is an object of the present invention to provide an antenna configuration that guarantees continuously stable radio reception of high quality for motor vehicles having a variable roof structure, i.e. having roof designs that are made mainly of dielectric parts, by means of new solution paths with regard to antenna position and feed connection, as well as ground connection, both in detail and in interaction.

These and other objects are accomplished, according to the invention, by an antenna configuration including a combination of emitters that are integrated into elements of the roof region, with emitters that are disposed in cavities of the interior paneling, essentially below the belt line of the vehicle; a ground connection for emitters that are disposed in a roof structure having movable elements by way of at least one resilient contact between movable metal components of the roof structure and the metal car body; and a switching system for alternating operation of the emitters. Preferred embodiment details and examples are discussed below.

The antenna configuration may have emitter structures in a window and in a roof made of dielectric material. The flat components having the emitters are surrounded by a metal frame, in each instance, which stands in contact with the metal car body by way of the rod system of the canopy frame.

Rod antennas, particularly short rod antennas, and wire sections may be placed as emitters in the cavities behind the molded parts of the interior paneling that are made of dielectric material.

The emitters may take the form of structured conductive coatings on the inside surface of the molded parts of the interior paneling that are made of dielectric material.

A ground contacting may be provided by way of guide pins and guide bushings of the canopy frame in combination with an additional spring element, whereby the spring element is resilient in the movement direction of the guide pin, in the end position when the canopy is closed, and presses against the face of the pin to guarantee a galvanic connection to the body sheet metal.

Resilient contacts for the ground connection may be provided at joints of the rod system parts of the canopy frame of a folding roof. A bent spring element may be affixed on one of the rod system parts connected by a joint, close to the joint, or a resilient friction spring is set onto the joint. A galvanic connection is present when the canopy is closed, in that the spring element presses against the material of the other rod system part of the canopy frame and/or the friction disk forms an electrical contact between the two adjacent rod system parts with a friction contact.

The invention defines new positions for emitters on motor vehicles, which are of particular interest for convertibles. Particularly with respect to the cavities behind molded parts of the interior paneling, close to the belt line, up to the present, nobody has thought about the possibility of placing emitters, whether wire-shaped or rod-shaped or as a metallic coating, in this area of the vehicle interior. However, even an emitter disposed on the inside of the deck in the rear seat region has been shown to benefit from the known effect of field line concentration along the edges of body elements of the vehicle. On the other hand, there are cavities in the roof construction, for example in side pieces or roof pieces made of dielectric material, in the upper region of the vehicle, which is advantageous for reception, which cavities are nevertheless not visible to the eye. In experiments, commercially available rod antennas, as well as metal structures specifically adapted to the cavities and paneling parts, were tested, and demonstrated consistently good reception properties.

Up to the present, there have always been difficulties for the vehicle types in question here, in connection with guaranteeing a "ground" that is sufficient for perfect antenna function, i.e. a ground connection in relation to the emitter type and the feed point. These problems result at least in increased costs for solutions that offer only partial functional reliability. For example, if one bridges the hinges of the roof rods of a fabric folding roof with expensive strips of braided copper wire, in order to produce a low-ohm connection between a ground connector in the roof region and the metal car body, costs are increased without obtaining complete reliability in function.

The continuous contacting according to the invention, with a non-positive and a positive connection, using simple spring elements and/or pairs of disks at the points of rotation of such a rod system, is functionally reliable and maintenance-free, and can be implemented with inexpensive materials and functional elements.

However, it must be seen in a compulsory interaction with the characteristic, according to the invention, of the metallic edging of emitter structures in surface elements of the roof structure, which must be consistently implemented, if one wishes to have the continuous connection to the car body, and thereby the advantages of the invention, develop its/their full effect.

BRIEF DESCRIPTION OF THE DRAWINGS

Other objects and features of the present invention will become apparent from the following detailed description considered in connection with the accompanying drawings. It should be understood, however, that the drawings are designed for the purpose of illustration only and not as a definition of the limits of the invention.

In the drawings, wherein similar reference characters denote similar elements throughout the several views.

DETAILED DESCRIPTION OF THE PREFERRED EMBODIMENTS

Figure 1:
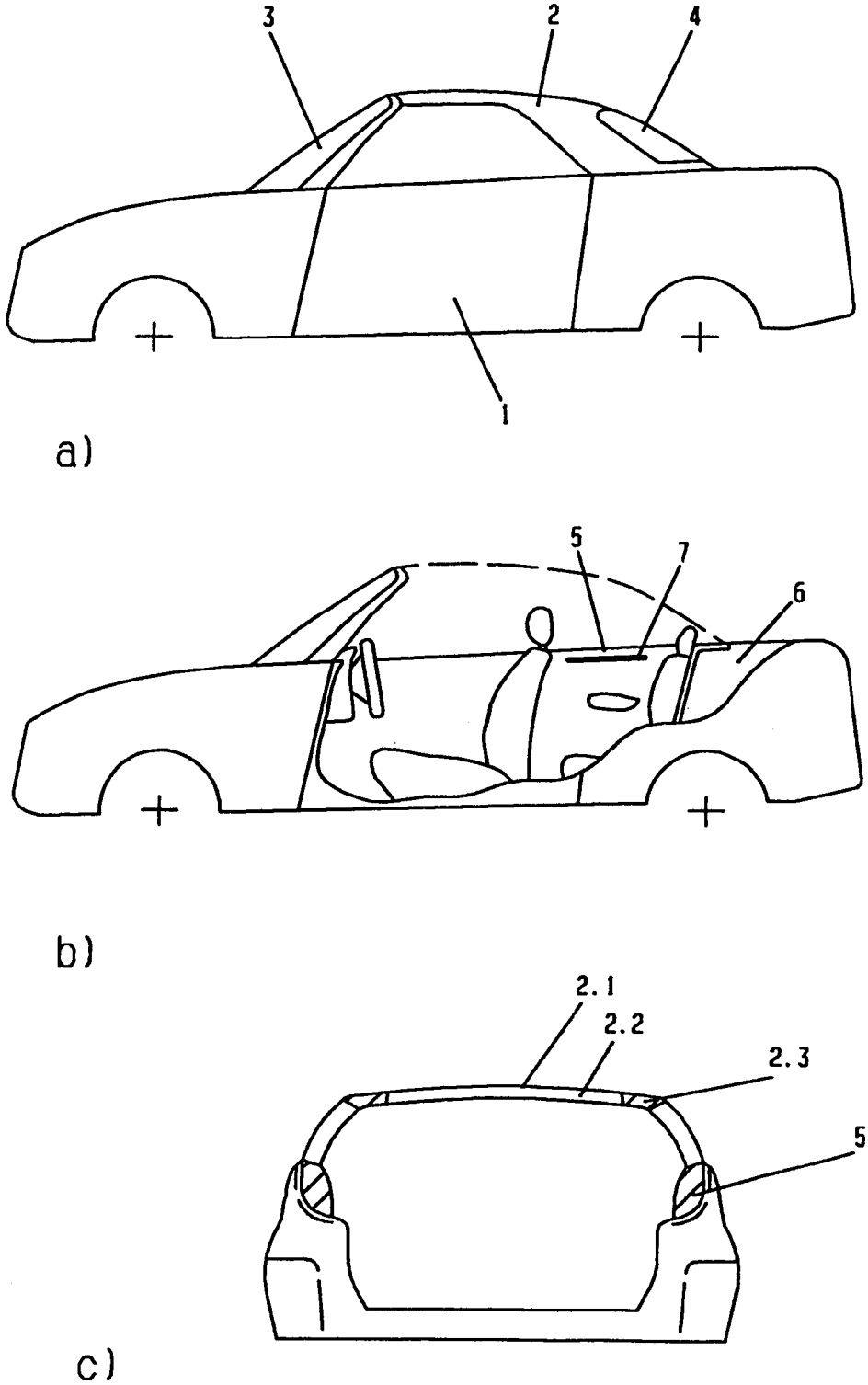
FIGS. 1*a*, 1*b*, and 1*c* shows a convertible in a side view (FIG. 1*a*), a side view in partial section (FIG. 1*b*), and a section in rear seat region, orthogonal to the longitudinal axis of the vehicle (FIG. 1*c*), respectively.

FIGS. 1*a*-1*b* show a convertible automobile including car body 1, roof 2, windshield 3, rear window 4, and trunk or canopy box 6. Car body 1 is made of metal and roof 2 is made of dielectric material. As shown in FIG. 1*c*, the car has an outside canopy 2.1, a cavity 2.2 between the outside canopy and the inside canopy or interior lining, and a cavity 2.3 in a side roof piece. Emitters 7 are disposed in cavities 5 of the interior paneling essentially below the belt line of the vehicle.

FIGS. 1*a*-1*c* illustrate the locations at which antennas were tested in positions according to the invention, and with which surprisingly good reception properties were determined. These are, in particular, the cavities 2.2 and 2.3 in the roof region, and the cavity behind the deck paneling 5. We laid pieces of wire, in part, and for a comparison, completely normal, commercially available short-rod antennas, into these cavities. In the case of plastic parts of the interior paneling, such as the paneling part or deck 5, a metallic coating can be provided, or a metallized film can be laid in. In each case, attention was paid to ensure a low-ohm ground connection, as short as possible, close to the feed point.

FIGS. 2 and 3*a*-3*d* show examples of low-ohm ground connections with spring elements, on the canopy frame 8 of a convertible.

Figure 2:
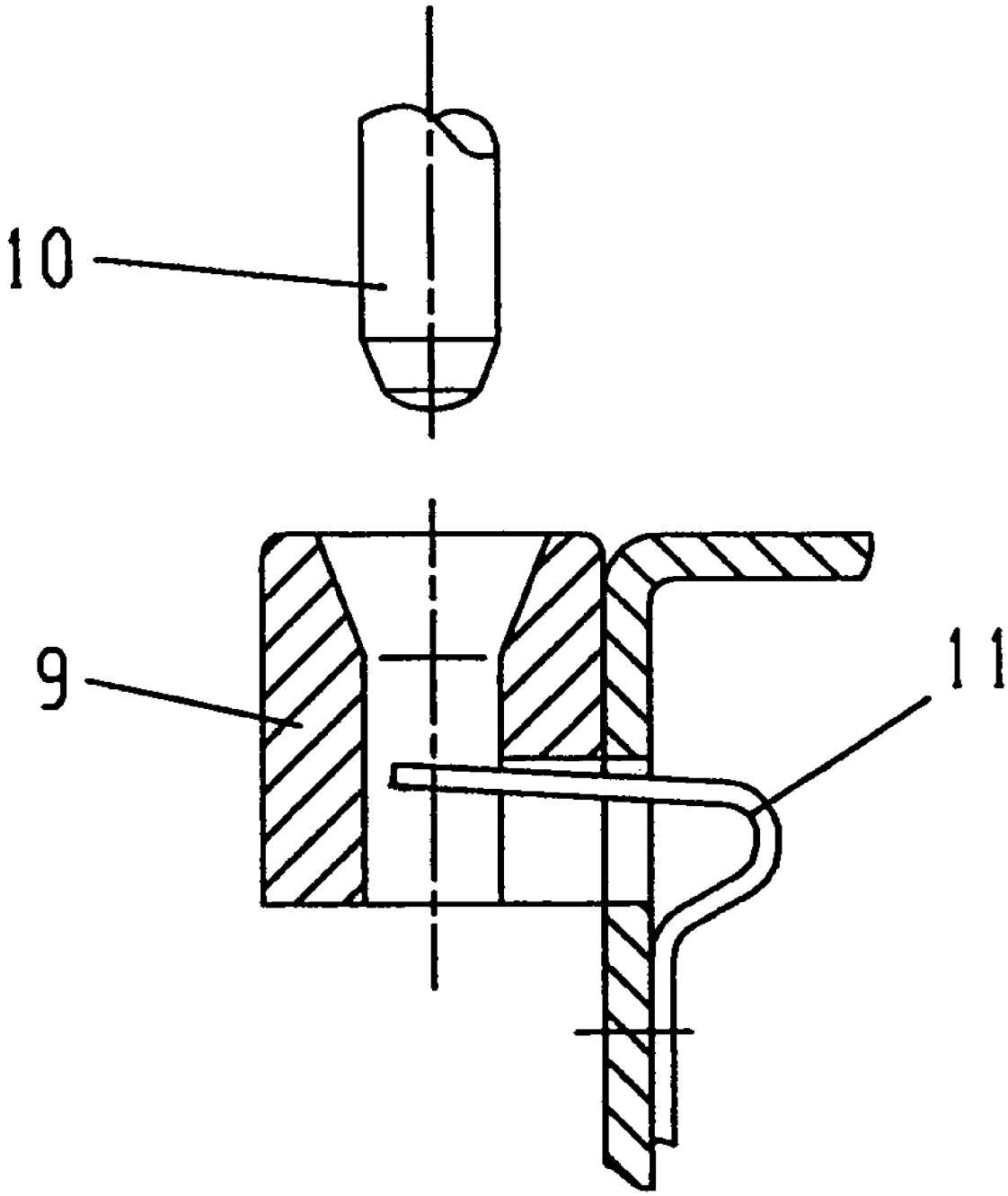
FIG. 2 shows a detail of a guide bushing with a guide pin for a canopy frame.

The mechanical guide unit for the canopy frame according to FIG. 2 is made up of the guide bushing 9 and the guide pin 10. It serves to adjust the canopy during the closing movement and secures the canopy frame 8 to prevent lateral tilting in the closed state.

Using the spring 11, which presses against guide pin 10 when the roof is closed, the required electrical contact and therefore a permanent ground connection between canopy frame and car body is guaranteed, specifically even in case of bump-related movements and any axial movements of the guide pin in the bushing that might be connected with them.

Figure 3:
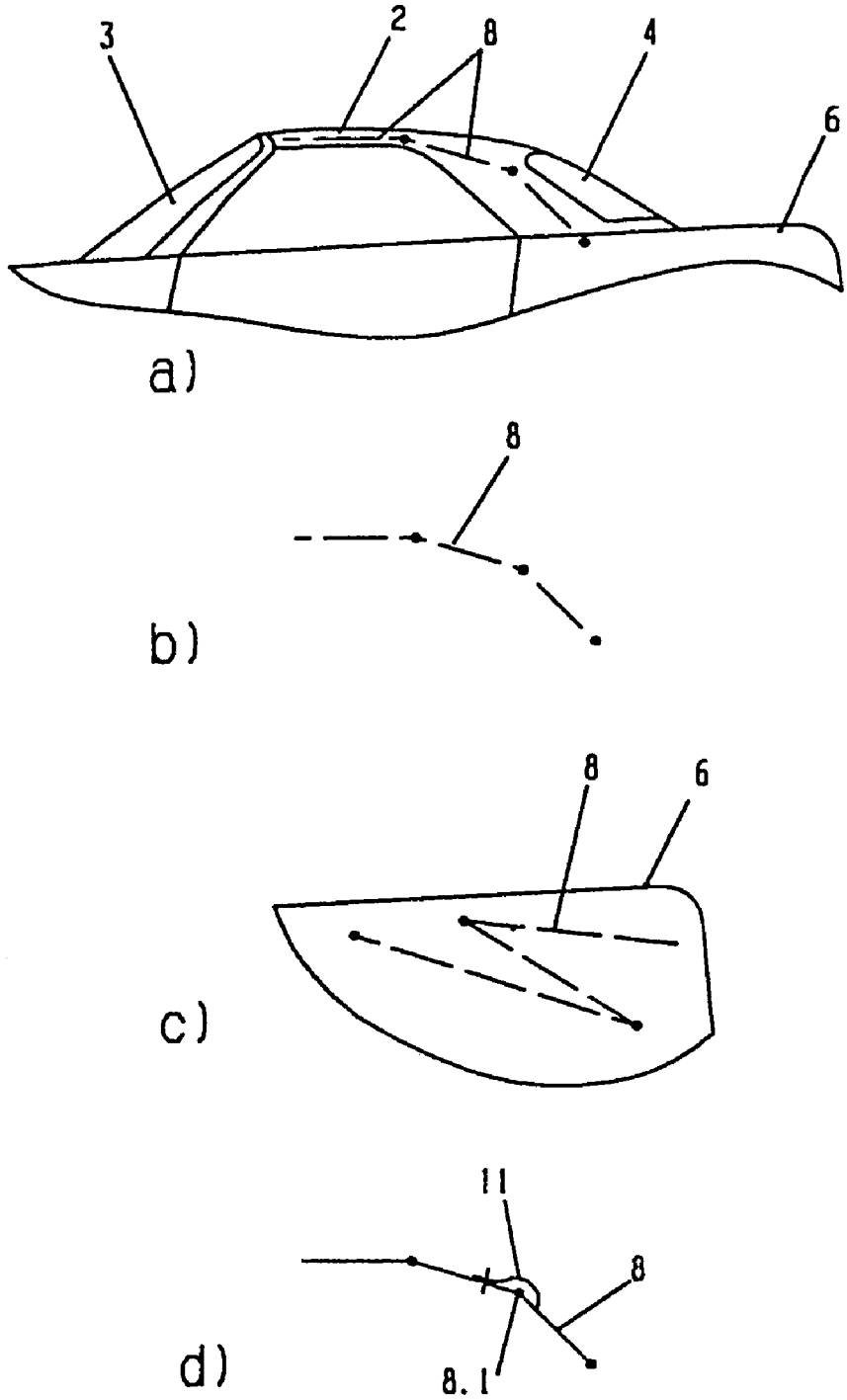
FIGS. 3*a*, 3*b*, 3*c*, and 3*d* show the contacting in a joint or hinge region in the case of convertibles with a canopy frame and flexible roof skin.

The same effect of equalizing mechanical movements of the canopy frame, here in the joints 8.1 of the rod system, is achieved with a spring element 11 that is attached to a lever next to the joint 8.1, as shown in FIG. 3*d*, and presses a "closed canopy" resiliently against the adjacent rod system part in the end position.

The two spring elements represent the continuous contact between the metal car body and the electrically conductive frame, which surround the dielectric surfaces of the roof region, according to the invention, and serve to make available a functionally sufficient ground for the antenna function.

Contacting with resilient contacts is qualitatively equivalent to the ground strip of braided copper wire; in contrast to a braided copper wire ground strip, however, the resilient contacts are less expensive and represent the only practicable solution in the case of the guide unit 10, 11.

Although a few embodiments of the present invention have been shown and described, it is to be understood that many changes and modifications may be made thereunto without departing from the spirit and scope of the invention as defined in the appended claims.

What is claimed is:

1. An antenna configuration for radio reception in a motor vehicle having a metal car body and interior paneling, said motor vehicle having an upper area and a lower area, the upper area and the lower area being separated by a belt line, said upper area comprising a roof area made substantially of dielectric material and a collapsible roof structure having movable metal components for open driving operation, comprising (a) a plurality of upper area emitters integrated into elements of the upper area and a plurality of lower area emitters disposed in the interior paneling in the lower area, said upper area emitters comprising emitters disposed in the roof structure;

(b) a ground connection for the emitters in the roof structure by way of at least one resilient contact between the movable metal components and the metal car body; and (c) a switching system for alternating operation of the emitters.

2. The antenna configuration according to claim 1 wherein the elements of the upper area comprise flat components in a window and in a roof made of dielectric material, each flat component being respectively surrounded by an electrically conductive frame in electrical contact with the metal car body by way of a rod system of the frame.

3. The antenna configuration according to claim 1 wherein the interior paneling comprises molded parts made of dielectric material and cavities behind the molded parts and the plurality of lower area emitters comprise rod antennas and wire sections in cavities behind the molded parts.

4. The antenna configuration according to claim 3 wherein the lower area emitters comprise structured conductive coatings on an inside surface of the molded parts.

5. The antenna configuration according to claim 1 further comprising a guide pin having a face and a movement direction a guide busing in a canopy frame of the vehicle, the canopy frame having an end closed position, wherein said at least one resilient contact comprises a first spring element and a second spring element, said second spring element being resilient in the movement direction of the guide pin when the canopy frame is in the end closed position and pressing against the face of the guide pin to guarantee a galvanic connection to the metal car body.

6. The antenna configuration according to claim 1 wherein the vehicle has a folding roof with a canopy frame comprising a rod system having rod system parts connected at joints, the antenna configuration further comprising a bent spring element affixed on one of the rod system parts near one of the joints, said spring element forming a galvanic connection when the roof is closed by pressing against another of the rod system parts of the canopy frame.

7. The antenna configuration according to claim 1 wherein the vehicle has a folding roof with a canopy frame comprising a rod system having rod system parts connected at joints, the antenna configuration further comprising a resilient friction disk spring set onto one of the joints, said friction disk spring forming a galvanic connection when the roof is closed by making a friction contact between two adjacent rod system parts to form an electrical contact.

* * * * *